US008172366B2

(12) United States Patent
Akahane

(10) Patent No.: US 8,172,366 B2
(45) Date of Patent: May 8, 2012

(54) LIQUID JETTING HEAD

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 405 days.

(21) Appl. No.: 12/188,263

(22) Filed: Aug. 8, 2008

(65) Prior Publication Data

US 2009/0278896 A1 Nov. 12, 2009

(30) Foreign Application Priority Data

Aug. 10, 2007 (JP) ..... 2007-208838
Jul. 25, 2008 (JP) ..... 2008-192198

(51) Int. Cl.
*B41J 2/14* (2006.01)
*B41J 2/045* (2006.01)
*B41J 2/175* (2006.01)

(52) U.S. Cl. ..... 347/50; 347/68; 347/85

(58) Field of Classification Search ..... 347/68–72, 347/85, 50, 58, 89
See application file for complete search history.

(56) References Cited

U.S. PATENT DOCUMENTS

| | | | | |
|---|---|---|---|---|
| 5,265,315 | A * | 11/1993 | Hoisington et al. | 29/25.35 |
| 7,070,263 | B2 * | 7/2006 | Okazawa | 347/68 |
| 7,168,791 | B2 * | 1/2007 | Hoisington et al. | 347/68 |
| 2005/0243130 | A1 * | 11/2005 | Essen et al. | 347/50 |
| 2005/0243145 | A1 * | 11/2005 | Essen | 347/84 |

FOREIGN PATENT DOCUMENTS

| | | |
|---|---|---|
| JP | 09-314833 | 12/1997 |
| JP | 2004-074678 | 3/2004 |
| JP | 2004-082608 | 3/2004 |
| JP | 2007-090690 | 4/2007 |
| WO | 98/57809 | 12/1998 |

* cited by examiner

*Primary Examiner* — Geoffrey Mruk
(74) *Attorney, Agent, or Firm* — Maschoff Gilmore & Israelsen

(57) ABSTRACT

Disclosed is a liquid jetting head which can contribute to downsizing. A head unit 20 has two case channels and a driving substrate 28 arranged between inflow openings 35 of the case channels provided on a base surface of the head unit, which is on the opposite side of a nozzle-formed surface of the head unit, in an erect posture with respect to the base surface of the driving substrate 28.

5 Claims, 6 Drawing Sheets

LIQUID JETTING HEAD

The present invention contains subject matters related to Japanese Patent Application No. 2007-208838 and Japanese Patent Application No. 2008-192198 filed in the Japanese Patent Office on Aug. 10, 2007 and Jul. 25, 2008, respectively, the entire contents of which are incorporated herein by reference.

BACKGROUND OF THE INVENTION

The present invention relates to a liquid jetting head, such as an ink jet-type recording head, and more particularly to a liquid jetting head having a head unit, which is capable of jetting liquid contained in a liquid containing chamber from nozzle orifices by driving pressure generating units, and a driving substrate, which supplies the pressure generating units with a driving signal.

A representative of a liquid jetting head which can jet (discharges) liquid may be an ink jet-type recording head (hereinafter, referred to as recording head) which is mounted in an ink jet-type printer (a kind of liquid jetting apparatus, hereinafter referred to as printer) which performs a record by discharging ink in a liquid state and striking a recording medium (a jetting object), such as recording paper with the ink. Further examples of the liquid jetting head include a color material jetting head used for manufacturing a color filter of a liquid crystal display, an electrode material jetting head used for forming electrodes of an organic electro luminescence display (organic EL display) and a field emission display (FED), and a living organic substance jetting head used for manufacturing a bio-tip (a biochemical element).

The liquid jetting head includes a driving substrate (printed board, circuit board) which receives a driving signal from an apparatus main body and supplies the driving signal to pressure generating units. The driving substrate is provided in a case member. In the liquid jetting head, the driving signal is supplied to each of the pressure generating units from the driving substrate via wiring members having flexibility (hereinafter, referred to as flexible cable), such as tape carrier package (TCP) (refer to seventh page of Patent document 1). Further, a terminal portion which is located at an end of the flexible cable is connected to a terminal portion of the pressure generating unit, and the other terminal portion which is located at the other end of the flexible cable is connected to a substrate terminal portion provided on the driving substrate.

In the structure disclosed in Patent document 1, the pressure generating units (vibrator units) are received in a receiving space formed in the case member, the driving substrate is arranged so as to cover an upper opening of the receiving space while being disposed in parallel with a nozzle formed-surface, and an introducing needle unit is attached to the case member in the state in which an driving substrate is interposed between the case member and the introducing needle unit. That is, the liquid jetting head is structured in a manner such that the driving substrate is provided with a through-hole having a size as large as the flexible cable can pass therethrough and wiring between the driving substrate and the pressure generating unit is accomplished by the flexible cable passing through the through-hole. That is, an end of the flexible cable with the other end connected to the pressure generating unit is connected to the driving substrate by a soldering method in which some solder is pulled to pass through the through-hole and then bent toward a connection terminal formed-surface of the driving substrate.

However, in the case in which the driving substrate is provided with the through-hole, wiring patterns must be formed on the driving substrate so as to detour around the through-hole. For such a reason, a size of the driving substrate in a plan view increases, resulting in a large driving substrate. As a result, a problem, in which the entire volume of the liquid jetting head increases, arises. In these days, line-type heads, in which a plurality of liquid jetting heads are incorporated in a body to jet liquid to a large area at a single time, are put to practical use. Accordingly, it is expected that the liquid jetting head progresses in downsizing when considering application of the line-type head to the liquid jetting head.

SUMMARY OF THE INVENTION

Accordingly, it is an object of the present invention to provide a liquid jetting head which can contributes to downsizing.

In order to accomplish such an object of the invention, there is provided a liquid jetting head including a head unit which can jet liquid contained in a liquid containing chamber through a nozzle orifice by operation of a pressure generating unit and a driving substrate which supplies the pressure generating unit with a driving signal, in which the head unit includes a first communication liquid channel which is provided at one end of the head unit and which communicates with the liquid containing chamber and a second communication liquid channel which is provided the other end of the head unit and which communicates with the liquid containing chamber, and in which the driving substrate is arranged between an inflow opening of the first communication liquid channel provided on a base surface which is opposite to a nozzle formed-surface of the head unit and an inflow opening of the second communication liquid channel in an erect posture with respect to the base surface.

With such a structure, the driving substrate is arranged in an erect posture on the base surface between the inflow openings of the first and second communication liquid channels provided on the base surface which is located at the opposite side of the nozzle formed-surface of the head unit. Accordingly, it is possible to reduce the horizontal size of the liquid jetting head regardless of the size of the driving substrate. Moreover, with such a structure, there is no need for a through-hole provided to the driving substrate which allows the flexible cable to pass therethrough. Accordingly, it is possible to reduce the size of the driving substrate. Furthermore, unlike the known structure, with such a structure, there is no need to bend the flexible cable when wiring the flexible cable and the driving substrate. Accordingly, it becomes easy to wire the flexible cable and the driving substrate.

In the structure, it is preferable that the driving substrate be arranged at a center portion of the base surface of the head unit.

According to the structure, the driving substrate is arranged at the center portion. With such a structure, it is possible to suppress fluctuation of lengths of the wirings, each is connected between the driving substrate and each of the pressure generating chambers, for every pressure generating chamber in comparison with the structure in which the driving substrate is arranged at a position other than the center portion, and it is also possible to suppress fluctuation of electric resistances of the wirings. Thanks to such a structure, fluctuation of a voltage of the driving signal which drives the pressure generating unit decreases. As a result, it is possible to reduce the range of fluctuation of the amount of liquid jetted from each nozzle orifice.

Further, thanks to the structure in which the communication liquid channels are arranged at both sides of the driving substrate arranged at the center portion of the base surface, the whole size of the liquid jetting head can be reduced in comparison with a structure in which the communication liquid channels are arranged at any one side of the driving substrate.

Furthermore, since there is no need for a clearance hole, through which the channel passes and which is provided to the wiring substrate like the known structure, it is possible to reduce the chance that a short-circuited state occurs at the time of liquid leakage which is likely to occur.

In the above-mentioned structure, it is preferable that the liquid jetting head include a liquid introducing member equipped with a liquid supply path which takes in liquid from the liquid source and supplies the liquid to the first communication liquid channel and the second communication liquid channel.

In the above-mentioned structure, it is preferable that the liquid introducing member be provided with a substrate holding portion which holds the driving substrate in an erect posture.

In the above-mentioned structure, it is preferable that an introducing portion of the liquid supply path is arranged at a side of the driving substrate in a widthwise direction thereof.

According to the structure, the driving substrate is held in the substrate holding portion of the liquid introducing member and the introducing portion of the liquid supply path is arranged at one side of the driving substrate in a widthwise direction thereof. Accordingly, it is possible to stably arrange the driving substrate in an erect posture and it is possible to adopt a layout in which the driving substrate and the liquid supply path are separated from each while suppressing the increase of the size of the liquid jetting head in a direction perpendicular to the surface of the driving substrate. With such a structure, it becomes possible to reduce the chance of the short-circuited state which is likely to occur.

In the above-mentioned structure, it is preferable that the liquid supply path branch off into a first branch supply path and a second branch supply path, the first branch supply path be provided so as to communicate with the first communication liquid channel which is relatively close to the introducing portion, and the second branch supply path be provided so as to communicate with the second communication liquid channel which is relatively far from the introducing portion while detouring around the driving substrate.

Moreover, in the above-mentioned structure, it is preferable that the first communication liquid channel and the second communication liquid channel be provided so as to communicate with both end portions of the same liquid chamber, respectively.

DESCRIPTION OF THE PREFERRED EMBODIMENTS

Hereinafter, preferred embodiments for practicing the invention will be described with reference to the accompanying drawings. In the following embodiments, various kinds of limitation are given as concrete examples. However, the scope of the invention is not limited to those aspects as long as there is no particular description of the effect that the examples limit the invention in the following explanation. In the embodiments, an ink jet-type recording head (hereinafter, referred to as recording head) is disclosed as an example of a liquid jetting head.

Figure 1:
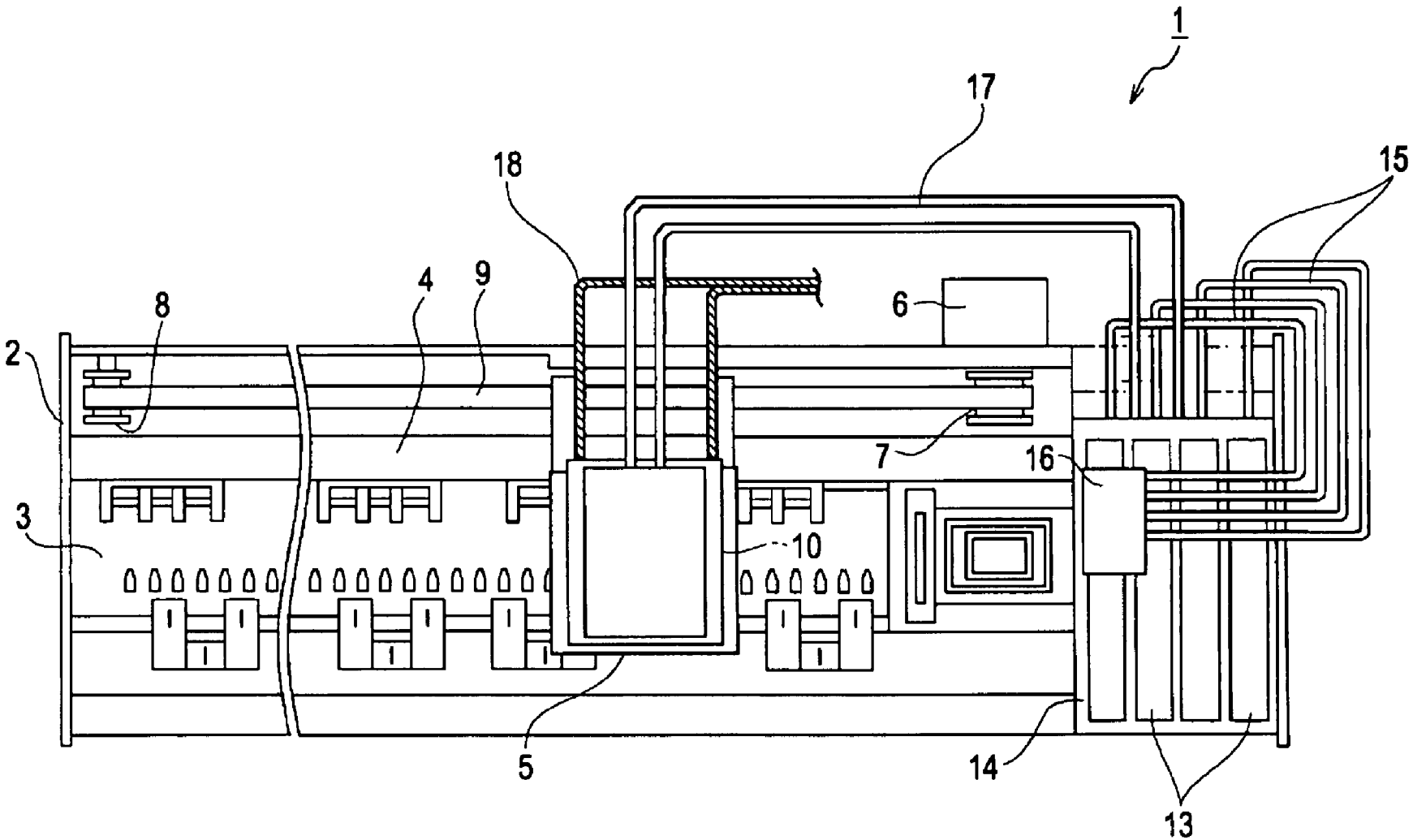
FIG. 1 is a plan view for explaining a structure of a printer.

FIG. 1 is a plan view showing a structure of a printer 1 on which a recording head 10 according to the invention is mounted. The printer 1 includes a frame 2 and a platen 3 arranged in the frame 2 and is structured in a manner such that recording paper (recording medium or one kind of jetting object, not shown) on the platen is transported by a paper sending roller (not shown) which rotates as a paper sending motor drives. Further, a guide rod 4 is installed in parallel with the platen 3 in the frame 2. A carriage 5 which has the recording head 10 therein is supported by the guide rod 4 in a pivotable manner. The carriage 5 is connected to a timing belt 9 installed between a driving pulley 7 rotated by operation of a pulse motor 6 and an idling pulley 8 installed at the opposite side of the driving pulley 7 in the frame 2. The carriage 5 is structured so as to reciprocate along the guide rod 4 in a main scanning direction which is perpendicular to a paper transportation direction by operation of the pulse motor 6.

A cartridge holder 14, in which an ink cartridge 13 is detachably mounted, is installed at one side of the frame 2. The ink cartridge 13 is connected to an air pump 16 via an air tube 15 and air from the air pump 16 is supplied into each of the ink cartridges 13. As the inside of the ink cartridge 13 is pressurized by the air, ink is supplied (pneumatic transportation) to the recording head 10 via an ink supply tube 17.

The ink supply tube 17 is a hollow member, which is flexible and is made of synthetic resin, such as silicon, and an ink channel corresponding to each of the ink cartridges 13 is formed in the ink supply tube 17. A flexible flat cable (FFC) 18 for transmitting a driving signal from a control portion (now shown) of a main body of the printer 1 to the recording head 10 is wired between the main body side of the printer 1 and the recording head 10 side.

Figure 2:
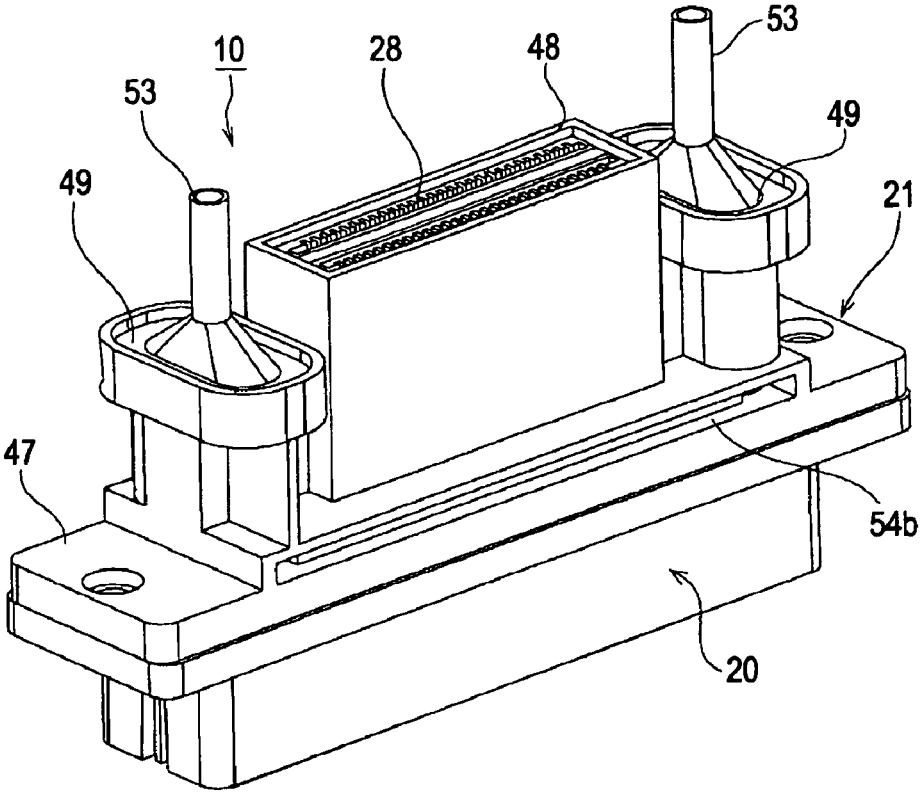
FIG. 2 is a perspective view of a recording head.
Figure 3:
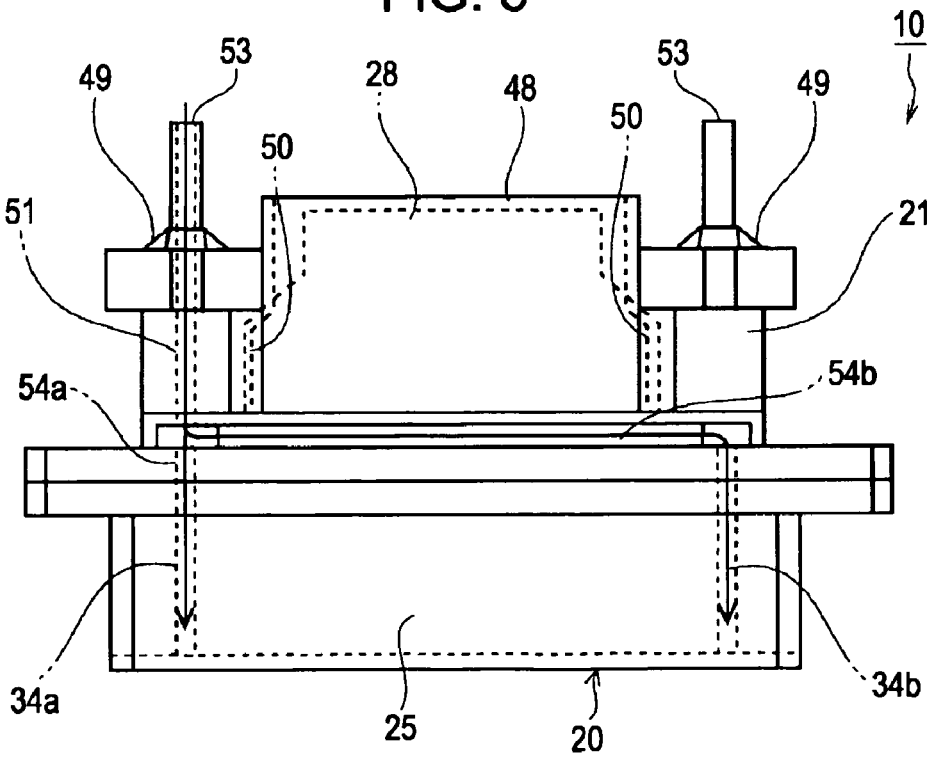
FIG. 3 is a front view of the recording head.
Figure 4:
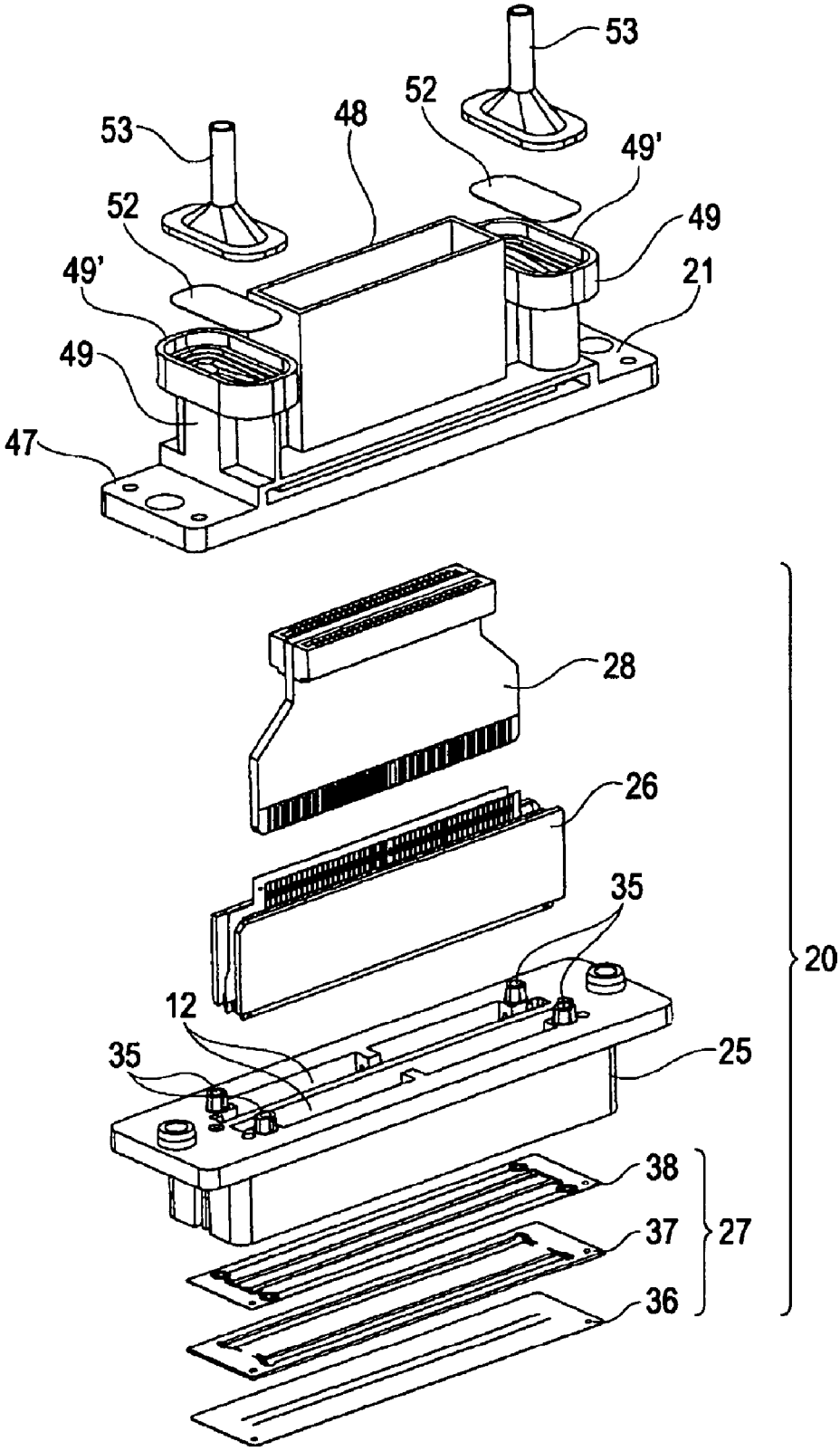
FIG. 4 is an exploded perspective view of the recording head.
Figure 5:
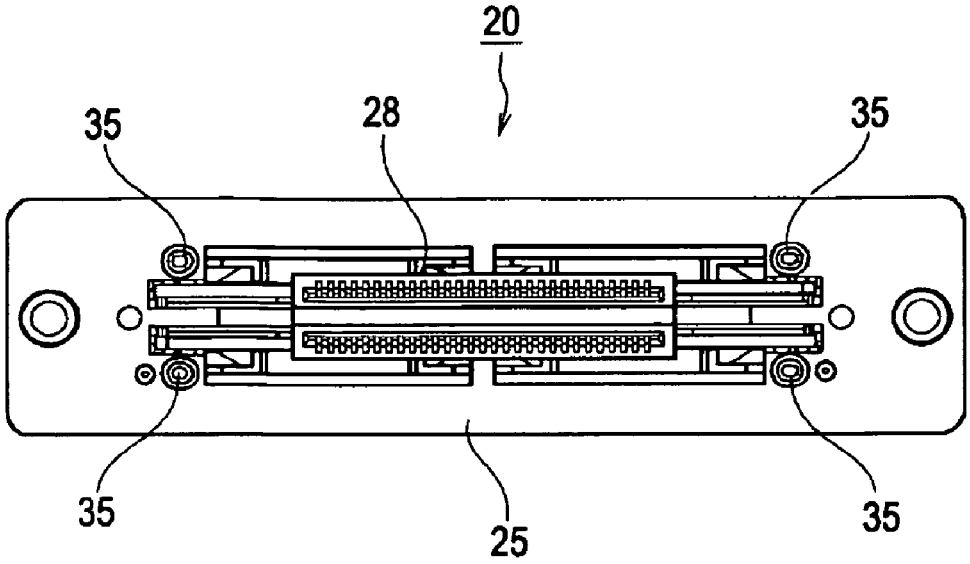
FIG. 5 is a plan view of a head unit.
Figure 6:
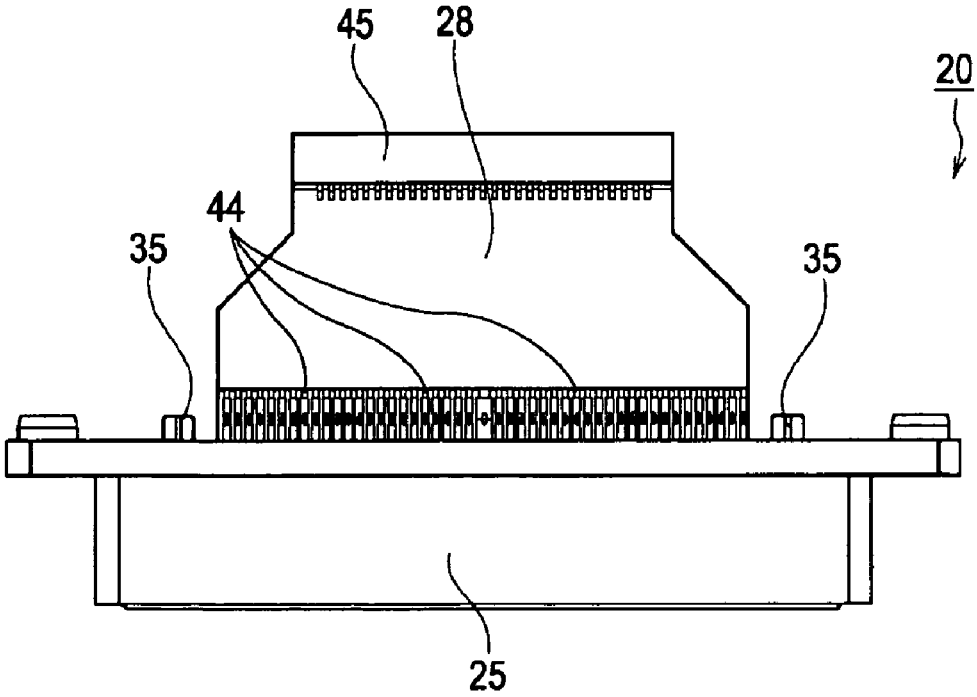
FIG. 6 is a front view of the head unit.
Figure 7:
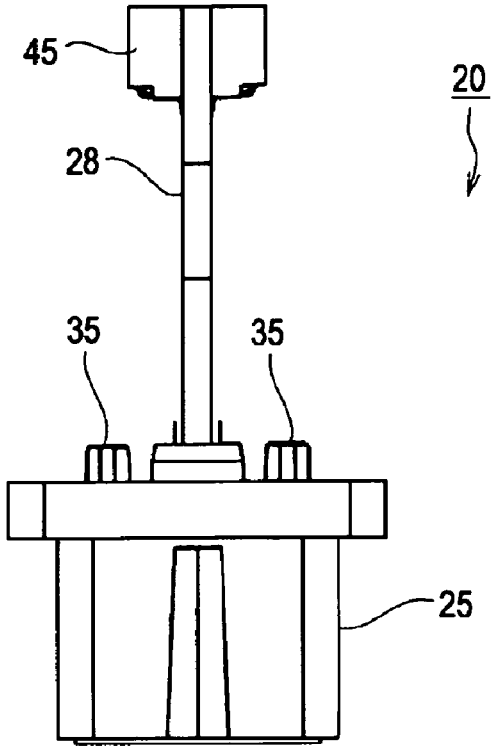
FIG. 7 is a side view of the head unit.
Figure 8:
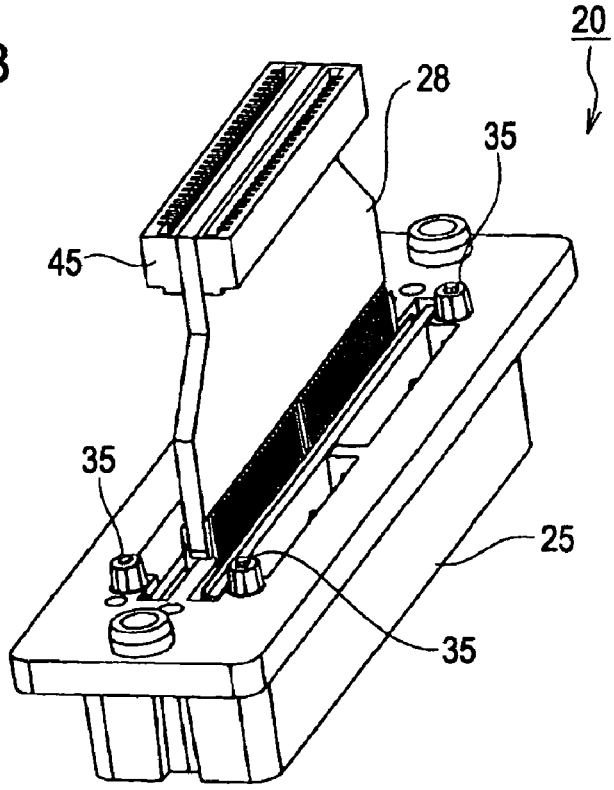
FIG. 8 is a perspective view of the head unit.
Figure 9:
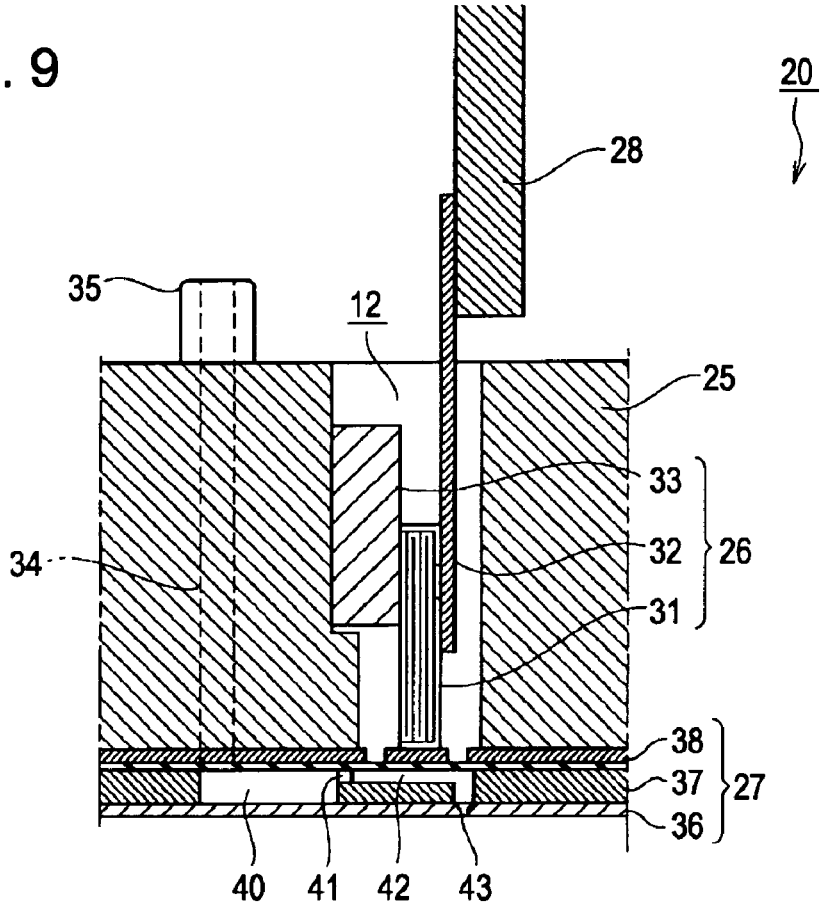
FIG. 9 is a sectional view of a main part of the head unit.

FIGS. 2 to 8 show the structures of the recording head 10. FIG. 2 is a perspective view of the recording head 10, FIG. 3 is a front view of the recording head 10, and FIG. 4 is an exploded perspective view of the recording head 10. FIG. 5 is a plan view of the recording head 10 (i.e. head unit 20) in a state in which an introducing needle unit 21 is not attached to the recording head 10. FIG. 6 is a front view of the recording head in the same state. FIG. 7 is a side view of the recording head 10 in the same state and FIG. 8 is a perspective view of the recording head 10 in the same state. FIG. 9 is a sectional view illustrating a main part of the head unit 20.

The recording head 10 in this embodiment includes the head unit 20 and the introducing needle unit 21 (one kind of liquid introducing member) as main elements. The head unit 20 consists of a head case 25, a vibrator unit 26, a channel unit 27, and a driving substrate 28.

The head case 25 is a hollow box-shaped member and has a leading surface (bottom surface) to which the channel unit 27 is fixed. The vibrator unit 26 is received in the receiving space 12 formed in the case, and the driving substrate 28 and the introducing needle unit 21 are arranged on the upper surface of the head case 25 which is opposite to the leading end surface. The upper surface of the head case 25 is a base surface of the head unit 20. Case channels 34 are formed in the head case 25 while extending so as to penetrate through the head case 25 in a height direction of the head case. The case channels 34 are channels for supplying ink from the introducing needle unit 21 side to the common ink chambers 40 (corresponding to the liquid chambers in this invention). The case channels 34 are provided in a manner such that two rows of case channels 34 are provided for each common ink chamber 40. With this embodiment, the recording head 10 includes two common ink chambers 40 corresponding to two sets of nozzle columns (a kind of nozzle group), and therefore the total four rows of case channels 34 are formed in the case head 25. Further, inflow openings 35, which are upstream side ends of the case channels 34, are formed to protrude from the upper surface of the head case 25. The inflow openings 35 are provided so as to communicate with the ink supply paths 51 (branch supply paths 54) of the introducing needle unit 21.

Figure 10:
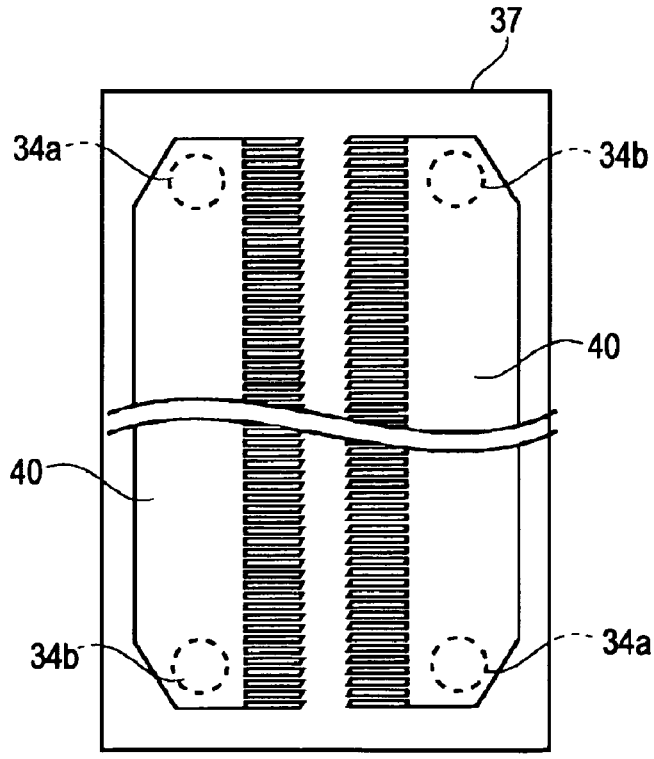
FIG. 10 is a plan view of a channel formed-substrate.

As shown in FIG. 10, of two case channels 34 corresponding to one common ink chamber 40, one case channel, i.e. a first case channel 34*a* (corresponding to a first communication liquid channel in the invention) communicates with the common ink chamber 40 at one end portion of the head unit 20. In greater detail, the first case channel communicates with one end portion of the head unit 20, the end being in a lengthwise direction (nozzle column direction) of the common ink chamber 40. the other case channel, i.e. a second case channel 34*b* (corresponding to a second communication liquid channel in the invention) communicates with the common chamber 40 at the other end portion of the common ink chamber 40, other than the above-mentioned end portion, in the lengthwise direction of the common ink chamber 40. Accordingly, thanks to a structure in which ink is introduced into the common ink chamber 40 from both side end portions of the common ink chamber in the widthwise direction, as for each of the pressure generating chambers 42 which communicates with the common ink chamber 40, it is possible to reduce loss of ink supply pressure in comparison with a structure in which ink is supplied from only a center portion of the common ink chamber 40 in the widthwise direction. Therefore, it is possible to equalize jetting characteristics of the pressure generating chambers.

The vibrator unit 26 includes a plurality of piezoelectric vibrators 31 (a kind of pressure generating unit) arranged in a comb-teeth form, a flexible cable 32 (a kind of wiring member) for supplying a driving signal which is output from the driving substrate 28 to the piezoelectric vibrators 31, and a fixing plate 33 which fixes the piezoelectric vibrators 31. The piezoelectric vibrators 31 are bonded to a flexible surface (vibrating plate 38) which sections a portion of the pressure generating chamber 42. Each of the piezoelectric vibrator 31 changes a pressure of ink contained in the pressure generating chamber 42 by increasing and decreasing a volume of each of the pressure generating chambers 42 by expanding or contracting itself with the driving signal which is applied. Therefore, it is possible to jet ink from the nozzle orifices 43 by controlling the pressure fluctuation.

The channel unit 27 is manufactured by stacking a nozzle-formed substrate 36 provided with the nozzle orifices 43, a channel-formed substrate 37 which forms ink channels, and a vibrating plate 38 which seals openings of the channel-formed substrate 37 and integrating them into a single body. The channel unit 27 is a unit member which forms a series of ink channels (liquid channels) which extend from the common ink chambers 40 to the nozzle orifices 43 by way of ink supplying holes 41 and the pressure generating chambers 42. The pressure generating chambers 42 branching off from the common ink chamber 40 are formed so as to correspond to the nozzle orifices 43, respectively and structured in a manner such that ink is supplied from the introducing needle unit 21 side via the case channels 34 and the common ink chambers 40. The channel unit 27 is bonded to the leading end surface of the head case 25 in a posture in which the nozzle-formed substrate 36 faces downward (i.e. faces the platen 3 side of the printer main body). Accordingly, in the head unit 20, the nozzle-formed substrate 36 becomes a nozzle-formed surface.

The driving substrate 28 is electrically connected to the substrate terminal portion 44 (see FIG. 6) in a manner such that the flexible cable 32 is connected to the substrate terminal portion 44 by a soldering method. The driving substrate 28 is equipped with a connector 45 which connects the driving substrate 28 to the FFC 18 of the printer main body, so that the driving substrate 28 receives a driving signal from the control portion via the FFC 18 and supplies the driving signal to the piezoelectric vibrators via the flexible cable 32. The flexible cable 32 has a structure in which wiring patterns made of conductive material, such as copper clad, are formed on the surface of a base film 43 made of an insulation film, such as polyimide, and portions other than wiring terminals are covered with resist. Accordingly, the wiring which allows the substrate terminal portion 44 of the driving substrate 28 and individual terminals of the piezoelectric vibrators to be in an electrically conducted state are provided in a plural number which equals to the number of piezoelectric vibrators.

As shown in FIGS. 5 and 6, the driving substrate 28 is arranged at the center portion of the upper surface of the head case 25 in a posture in which the head case 25 erects with respect to the upper surface of the head case 25 and rests in parallel with nozzle columns. The driving substrate 28 is arranged in such a posture at an area between inflow openings 38 of the first case channel 34*a* and the second case channel 34*b* which directly communicate with the same common ink chamber 40 (a center portion area of the upper surface of the head case 25 in this embodiment) on the upper surface of head case 25. That is, the driving substrate 28 is disposed in an erect posture with respect to the nozzle-formed surface of the head unit 20 and the base surface. Accordingly, the driving substrate 28 is held maintaining such a posture by the introducing needle unit 21. This will be described below.

Besides the driving substrate 28, the upper surface of the head case 25 (the base surface of the head unit 20) is provided with the introducing needle unit 21. The introducing needle unit 21 includes a base portion 47 which is formed by a molding method using synthetic resin and has almost the same size as the upper surface of the head case 25, a substrate holding portion 48 which extends upward from a center portion of the base portion 47 (on an opposite side of the head unit side), and ink introducing portions 49 (corresponding to introducing portions in the invention) which are provided at both sides of the substrate holding portion 48 in the base portion 47 (both sides in a nozzle column direction).

The substrate holding portion 48 has a box shape which is open at an upper end and a lower end. The inside of the substrate holding portion 48 is structured so as to receive and hold the driving substrate 28. On the inner surface of a wall of the substrate holding portion 48 which is close to the ink introducing portion 49, a fitting rail portion 50, having a shape of letter "U" rotated by a quarter angle in a counter clockwise direction, extends in a height direction of the substrate holding portion 48 (see FIG. 3). The fitting rail portion 50 is structured so as to fit to a peripheral boarder of the driving substrate 28 and functions as a guide when receiving the driving substrate 28 in the substrate holding portion 48 and determines a position and a posture of the driving substrate 28 in the received state. That is, as shown in FIG. 2, in the state in which the driving substrate 28 is received in and held by the substrate holding portion 48, the driving substrate 28 is arranged in an erect posture with respect to the upper surface of the head case 25.

The ink introducing portion 49 has ink supply paths 51 (a kind of liquid supply path in the invention), which introduce ink transported from the ink cartridge 13 via the ink supply tube 17 by pressure into the head unit 20, formed therein. The ink supply path 51 is provided for each of every color of ink, i.e. each of every common ink chamber 40. The ink introducing portion 49 is arranged at both sides of the substrate holding portion 48 with respect to the introducing needle unit 21, i.e. at sides of the driving substrate 28 (in a substrate width direction) which is held by the substrate holding portion 48. Further, the ink introducing needle 53 (liquid introducing needle) is attached to an upstream side opening 49' of the ink introducing portion 49 via a filter 52 interposed therebetween. The ink introducing needle 53 is equipped with a self-sealing valve (not shown) which allows ink to be introduced into the ink introducing needle 53 by adjusting a pressure of ink which is transported from the ink supply tube 17.

The ink supply path 51 provided in the ink introducing portion 49 branches off into a first branch supply path 54*a* and a second branch supply path 54*b*. These branch supply paths 54*a* and 54*b* are provided so as to correspond to the case channels 34*a* and 34*b*, respectively which communicate with either one of the common ink chambers 40. That is, the first branch supply path 54*a* communicates with the first case channel 34*a* located close to the corresponding ink introducing portion 49 (i.e. located under the corresponding ink introducing portion 49), and the second branch supply path 54*b* communicates with the second case channel 34*b* located far from the corresponding ink introducing portion 49 (i.e. located under another ink introducing portion 49). The second branch supply path 54*b* is formed to detour around the substrate holding portion 48 (driving substrate 28). With this embodiment, a groove which is horizontally long and sags toward a rear side of the introducing needle unit 21 is formed at the front side of the introducing unit 21 and at an upper portion of the base portion 47, and the groove functions as part of the second branch supply path 54*b*. In FIGS. 2 and 3, the groove is shown in the open state but the opening of the groove is closed by resin film.

In a similar way, the ink supply path 51 of the other ink introducing portion 49 branches off into a first branch supply path 54*a* and a second branch supply path 54*b*. The branch supply paths 54*a* and 54*b* of this ink introducing portion 49 correspond to the case channels 34*a* and 34*b*, respectively which communicate with the other common ink chamber 40. The second branch supply path 54*b* is formed in a manner of detouring around the substrate holding portion 48 (driving substrate 28) on a back side surface of the introducing needle unit 21.

In the recording head 10 having the above-mentioned structure, when ink transported from the ink cartridge 13 via the ink supply tube 17 is introduced into the ink supply path 51 provided in the ink introducing portion 49 from the ink introducing needle 53, some portion of the ink is supplied to the first case channel 34*a* via the first branch supply path 54*a* and the rest of the ink is supplied to the second case channel 34*b* via the second branch supply path 54*b*. Accordingly, as for each of the common ink chambers 40, the corresponding common ink chamber 40 receives the ink from both of the case channels 34*a* and 34*b* by way of both sides (in a lengthwise direction) thereof.

As described above, in the recording head 10, the driving substrate 28 is arranged between the inflow openings 35 of the case channels 34*a* and 34*b*, respectively provided on the base surface of the head unit 20 in an erect posture with respect to the base surface. Accordingly, it is possible to reduce the horizontal plane size of the recording head 10, i.e. the size of the recording head 10 in a direction perpendicular to the nozzle column, regardless of the size of the driving substrate 28 in comparison with the known structure. As a result, the recording head 10 according to the invention is suitable for a line-type head in which a plurality of recording heads is incorporated in a body.

Further, since the driving substrate 28 is arranged at the center portion of the base surface of the head case 25, it is possible to suppress lengths of the wirings from the driving substrate 28 to the piezoelectric vibrators 31 from being lopsided for every piezoelectric vibrators 31 and it is possible to suppress fluctuation of electric resistance of the wirings in comparison with a structure in which the driving substrate 28 is arranged at a position other than the center position of the base surface of the case. For such a reason, it is possible to reduce the range of fluctuation of a voltage of the driving signal for driving the piezoelectric vibrators 31, resulting in the decrease of the range of fluctuation of the amount of ink jetted from the nozzle orifices 43.

Further, since the case channels 34*a* and 34*b* are arranged at both sides of the driving substrate 28 arranged at the center portion of the upper surface of the head case 25, it is possible to reduce the whole size of the recording head 10 in comparison with a structure in which the communication liquid channels gather at either one side of the driving substrate 28.

Moreover, since an arrangement position of the driving substrate 28 and an arrangement position of the channels do not overlap in a plan view (on the base surface of the case) like the known structure does, there is no need for a hole of the driving substrate 28 through which the channel passes. Accordingly, it is possible to reduce the chance of a short-circuited state which is likely to occur when ink leakage happens to occur. Further, there is no need to bend the flexible cable when wiring the flexible cable 32 and the driving substrate 28, the wiring work becomes easy.

Moreover, with this embodiment, the driving substrate 28 is held in the substrate holding portion 48 of the introducing needle unit 21 and the ink introducing portion 49 is arranged at a side of the driving substrate 28 (the side in the widthwise direction). Accordingly, it is possible to stably arrange the driving substrate 28 in an erect posture and it is possible to adopt a layout in which the driving substrate 28 and the ink supply path 51 are separated from each other while suppressing the increase of the size of the recording head 10 in a direction perpendicular to the driving substrate 28 (the direction perpendicularly intersecting the nozzle column). As a result, it is possible to reduce the chance of a short-circuited state which is likely to occur when ink leakage happens to occur.

Still moreover, with this embodiment, an example of applying the invention to the printer 1 which is a kind of an off-carriage-type liquid jetting apparatus is disclosed, but the invention can also be applied to an on-carriage-type liquid jetting apparatus.

The invention is not limited to the recording head 10 which is exemplified above but can be applied to a liquid jetting head mounted in a display manufacturing apparatus, an electrode manufacturing apparatus, a chip manufacturing apparatus, and a micropipette.

What is claimed is:

1. A liquid jetting apparatus comprising:

a control portion;

a head unit which can jet liquid contained in a liquid containing chamber through a nozzle orifice by operation of a pressure generating unit, the head unit having a driving substrate which receives a first driving signal from the control portion via a flexible flat cable and which supplies the pressure generating unit with a second driving signal; and a liquid introducing member having a liquid supply path which takes in liquid from a liquid source and supplies the liquid to a first communication liquid channel and a second communication liquid channel, wherein the driving substrate is provided on a base surface of the head unit which is opposite to a nozzle formed-surface of the head unit, wherein the liquid introducing member is fixed to the base surface of the head unit and has a substrate holding portion which maintains an erect posture of the driving substrate with respect to the base surface.

2. The liquid jetting apparatus according to claim 1, wherein an introducing portion of the liquid supply path is provided at a side of the driving substrate in a widthwise direction.

3. The liquid jetting apparatus according to claim 1, wherein the driving substrate is further equipped with a connector which connects the driving substrate to the flexible flat cable.

4. The liquid jetting apparatus according to claim 1, wherein the driving substrate is arranged at a center portion of the base surface of the head unit.

5. The liquid jetting apparatus according to claim 1, wherein the liquid supply path branches off into a first branch supply path and a second branch supply path, wherein the first branch supply path is provided so as to communicate with the first communication liquid channel relatively close to the introducing portion, and wherein the second branch supply path is provided so as to communicate with the second communication liquid channel relatively far from the introducing portion while detouring around the driving substrate.

* * * * *